US005860533A

United States Patent [19]

Wood

[11] Patent Number: 5,860,533

[45] Date of Patent: Jan. 19, 1999

[54] GRADER

[75] Inventor: Peter James Wood, Tayside, Scotland

[73] Assignee: Reekie Manufacturing Limited, Tayside, United Kingdom

[21] Appl. No.: 564,303

[22] PCT Filed: Jun. 21, 1994

[86] PCT No.: PCT/GB94/01341

§ 371 Date: Dec. 19, 1995

§ 102(e) Date: Dec. 19, 1995

[87] PCT Pub. No.: WO95/00260

PCT Pub. Date: Jan. 5, 1995

[30] Foreign Application Priority Data

Jun. 22, 1993 [GB] United Kingdom ..... 9312885

[51] Int. Cl.[6] ..... B07B 1/10

[52] U.S. Cl. ..... 209/308; 209/382; 209/386; 209/421; 171/15

[58] Field of Search ..... 209/681, 307, 209/308, 379, 382, 385, 386, 421; 171/15

[56] References Cited

U.S. PATENT DOCUMENTS 3,348,680 10/1967 Mathews et al. ..... 171/15 X 4,174,755 11/1979 Siri ..... 209/308 X

FOREIGN PATENT DOCUMENTS

| | | |
|---|---|---|
| 263909 | 1/1989 | Germany . |
| 914949 | 1/1963 | United Kingdom . |
| 2077626 | 12/1981 | United Kingdom . |
| 2143751 | 2/1985 | United Kingdom . |
| 2198103 | 6/1988 | United Kingdom . |
| WO9204816 | 4/1992 | WIPO . |

*Primary Examiner*—David H. Bollinger
*Attorney, Agent, or Firm*—Young & Basile, P.C.

[57] ABSTRACT

An endless conveyor grader (1) suitable for use in grading tubers (4) or the like. The endless conveyor comprises an endless grid screen (21) supported by an endless drive transmission (37) at opposite sides (23, 25) of the endless grid screen (21). An endless drive transmission guide (36, 39) is provided at opposite sides (23, 25) of the endless grid screen formed and arranged so as to define at least one cascade (40) or step (40) in the endless grid screen pathway. The cascade(s) or step(s) (40) allow for tumbling, in use of the grader of tuners (4) passing over the cascade(s) (40) or step(s) so as to provide the required movement of the tubers (4) on the grid screen (21) to facilitate the grading process. The grid screen comprises parallel support bars provided with a multiplicity of 'I'-shaped link members (46) bridging between the support bars (47) so as to allow the grid screen to change direction in the endless grid screen pathway.

27 Claims, 3 Drawing Sheets

GRADER

The present invention relates to a grader suitable for use in grading and separating potatoes at harvest but not exclusively.

Separators have long been used to separate smaller seed potatoes from larger potatoes as well as separating stones, earth and other debris collected during harvest. Grading, that is separating of potatoes more or less accurately on the basis of their size, is of considerable commercial importance for potato growers. For the producer of potatoes the value of ware potatoes which generally have a diameter greater than 55 mm, can be as little as one quarter of the value of seed potatoes which generally have a diameter within the range of from 35 to 55 mm—below 35 mm diameter potatoes are generally not considered suitable for use as seed. To the buyer of seed potatoes moreover the weight and hence cost of potatoes required for a given planting density will vary considerably with the size or diameter of the seed potatoes. There is accordingly a need for accurate grading of potatoes and not only between seed and ware but also for particular size ranges of seed potatoes e.g. 35 to 45 and 45 to 55 mm diameter. The sizing of seed potatoes is strictly controlled by the United Kingdom Department of Agriculture, and other national agricultural institutions.

Presently known graders generally use either continuous screens made of wire to form squares or sieve type screens which are both vibrated or oscillated vertically in an attempt to displace the potatoes thereon relative to the screen thereby to facilitate passage of smaller potatoes through the screen to be collected separately from larger potatoes which are carried further on by the screen to their own collecting point. Such violent agitation tends to cause the potatoes to jump up and down on the screen whereupon the potatoes may be damaged when they fall back onto the screen. Also such agitation is often of limited effectiveness insofar as the potatoes simply fall back into their original position in which they were held from passing through the screen, and/or the potatoes simply move up and down together with the screen so that there is little or no displacement of the potatoes relative to the screen. Damaged potatoes stored with sound potatoes can give rise to rot which can subsequently damage healthy potatoes and are significantly less attractive to prospective purchasers, be they wholesalers, shopkeepers, or ordinary shoppers, and it is therefore particularly important to avoid damage as far as possible.

It is an object of the present invention to avoid or minimise one or more of the above disadvantages.

The present invention provides an endless conveyor grader suitable for use in grading tubers or the like wherein the endless conveyor comprises an endless grid screen supported on endless drive transmission means at opposite sides of said endless grid screen, characterised in that there are provided at opposite sides of the endless grid screen pathway, endless drive transmission guide means formed and arranged so as to define at least one cascade or step in the endless grid screen pathway for tumbling, in use of the grader, tubers passing over said cascade or step thereby to provide the required movement of tubers on said grid screen to facilitate the grading process.

Various suitable guide means are known in the art but conveniently there are used guide means in the form of guide rollers or sprockets. These may simply be used as pairs of more or less closely spaced guide rollers or sprockets defining a generally 'S'-shaped pathway for the drive transmission means. The latter may be in the form of a belt, chain, cable or other like flexible endless connector.

Thus by means of the present invention, movement of tubers on the new screen and thereby improved grading efficiency, especially for elongate potatoes, may readily be provided in an economic and effective manner with a significantly gentler action on the tubers.

A particular suitable form of endless grid screen for use in the grader of the present invention comprises a multiplicity of substantially parallel support bars bridging across spaced apart endless drive transmission means with a multiplicity of generally 'I'-shaped link members with hollow cross-members bridging across pairs of successive support bars so as to define an endless grid screen with said bars extending through said hollow cross members, said hollow cross members having closely fitting male and female end portions for positive coupling of adjacent link members so as to allow relative rotation at the coupling whilst substantially maintaining dimensional stability of the grid screen openings in use of the endless grid screen, said hollow coupled cross-members having a minimum internal diameter slightly larger than the external diameter of said bars so as to allow relative movement between the grid screen link members and said support bars transversely of the support bars at non-rectilinear portions of the grid screen pathway, thereby facilitating traversal of changes of direction in the endless grid screen pathway whilst maintaining dimensional stability of the grid screen openings.

It will nevertheless be understood that the above-described endless grid screen may also be used in other forms of graders, harvesters or separators, apart from the grader of the present invention. Moreover the endless grid screen is not limited for use with tubers and may be used with a wide variety of other vegetables and fruits.

In order to provide an accurate grid screen opening size, and hence accurate grading, it is important that that the link members should be more or less accurately dimensioned. This can readily be achieved by means of suitable mass production techniques such as precision casting or moulding. Desirably the link members should be produced to within a principal dimensional tolerance of 0.25 mm, preferably 0.1 mm or less. Preferably the link members are formed of plastics materials e.g. polypropylene, polyamide, or polyvinylchloride, which are relatively light, durable and gentle to tubers. Conveniently such plastics link members are manufactured by injection moulding. The link members define openings which may have various shapes and/or configurations depending upon the particular vegetable or fruit product to be graded. Thus for example the openings may be square, rectangular, oval, round or polygonal.

One problem that can arise, especially with elongate tubers, is that they can become jammed within the grid screen openings, projecting partly therethrough. This can result in severe damage to these trapped tubers wherever the grid screen changes direction and/or when it traverses a full width drive or return roller.

Thus in a further aspect, the present invention provides an endless conveyor grader suitable for use in grading and separating tubers or the like and having an endless grid screen with a predetermined opening diameter, characterised in that there is provided, substantially directly upsteam of a change of direction in the endless conveyor pathway, extending substantially across the width of the conveyor web at or in close proximity to the underside of the conveyor web, an ejector roller having a large diameter of at least 2, preferably at least 3, times said predetermined opening diameter, for ejecting, in use of the separator, tubers or the like which may have become jammed in the grid screen openings.

Conveniently the ejector roller has a relatively smooth e.g. polished, substantially cylindrical surface, to allow sliding engagement with trapped tubers in order to minimize damage thereto. Advantageously there is used a driven ejector roller, said ejector roller preferably being driven in the same direction as the grid screen but at a slightly faster speed e.g. from 2 to 10% faster, desirably from 3 to 7% faster.

Advantageously an ejector roller is provided at each cascade or step in a grader of the present invention. Preferably the grader of the present invention is provided with at least 2 preferably from 3 to 6 cascades or steps.

Preferably there is provided an overhead conveyor to assist passage of tubers or the like downwardly through the grid screen. The overhead conveyor engages the tubers helping to retain them on the grid screen and to spread them across the width of grid screen, as well as helping to turn them on the grid screen, thereby assisting passage of the tubers through the grid screen. Moreover by varying the speed of the overhead conveyor relative to the grid screen, even to the extent of giving it a reverse direction of movement, turning of the tubers can be increased further. Futhermore by providing a non-planar surface topography e.g. ridges in the surface presented by fingers, pintles, bristles etc. of the overhead conveyor, spreading of the tubers can be further improved.

Most preferably said overhead conveyor is provided at least partly upstream of said cascade or step. Such an overhead conveyor is particularly advantageous where said tubers or the like are long and curled or of an unusual irregular shape which do not readily pass through said grid screen. Said overhead conveyor may be of any suitable form which can more or less positively engage and impart drive to tubers disposed on said grid screen. Preferably said overhead conveyor comprises an endless conveyor mounted on at least two return guides, and provided with suitable drive means. Conveniently the guides are in the form of guide rollers, at least one of which is provided with a drive means formed and arranged for driving said endless conveyor. Thus the conveyor may be in the form of an endless belt having a surface of resiliently deformable material, such as an open or closed cell foam polymeric material, e.g. a rubber sponge-like material. The use of such a resiliently deformable material helps reduce damage to said tubers during separation/grading.

In another form of overhead conveyor an endless belt or chain has mounted thereon a plurality of spaced apart paddles or flights, or a multipicity of fingers or bristles, projecting downwardly into close proximity with said grid screen so as to generally define compartments in which tubers on said grid screen may be captively retained on said grid screen.

It will be appreciated that whilst the overhead conveyor may conveniently be in the form of a single flexible endless conveyor extending along and over said grid screen, it could alternatively be in the form of a series of elements extending therealong e.g. a series of generally cylindrical brushes all rotating in the same direction for successively guiding and driving the tubers along said grid screen.

It will also be appreciated that the rate of flow of tubers over said grid screen may be controlled by adjusting the speed of the drive means to said endless overhead conveyor.

Preferably the overhead conveyor is mounted above the grid screen in such a way that its height above the grid screen can be varied with the aid of suitable height adjustment means thereby to accommodate different sizes of tuber and to some extent control the variable transit time of tuber flow and the degree of separation/grading.

Preferably the conveyor is provided with resilient biasing means formed and arranged for holding the conveyor run of the conveyor down at a desired pre-determined height above the grid screen whilst allowing transitory upward displacement thereof to pass over particularly large tubers or the like.

Conveniently there may be provided a plurality, desirably from two to four, nested endless conveyor graders according to the invention, mounted with their grading reaches one above the other, the uppermost grader having a larger grid screen opening then the grid therebelow and so on, so as to provide the ability to separate and grade a plurality of differently sized tubers in a single grader/harvester/separator.

It will of course be appreciated that whilst the graders of the present invention are particularly suitable for use with tubers like potatoes they may also be used with other materials in the form of discrete bodies of randomly mixed size which it is desired to grade more or less accurately, such as other vegetables or fruits or minerals such as coal.

In a further aspect the present invention provides a method of grading tubers or the like characterised in that said method comprises the steps of: providing an endless conveyor grader of the invention, and conveying said tubers or the like on said endless conveyor over said cascades or steps.

Further preferred features and advantages of the present invention will appear from the following detailed description given by way of example of some preferred embodiments illustrated with reference to the accompanying drawings in which.

Figure 1:
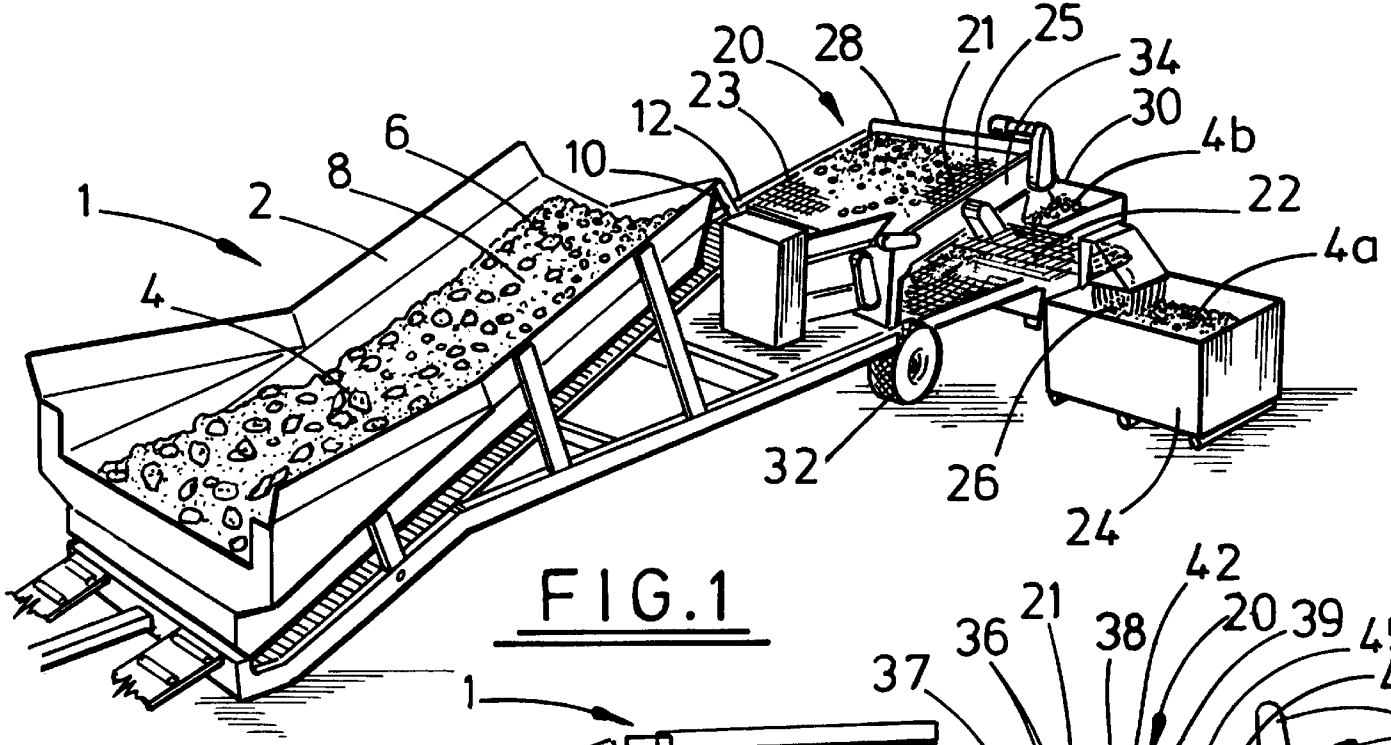
FIG. 1 is a perspective view of a potato grader and separator in use separating seed and ware potatoes.

FIG. 1 shows a potato grader generally indicated by reference number 1 in use for separating seed and ware potatoes 4. The grader and separator 1 comprises a bulk hopper 2 into which are loaded harvested potatoes 4. The hopper 2 is provided with soil extraction rollers 6 which remove excess soil 8 collected with the potatoes 4 and conveys the potatoes 4 to a manual precleaning conveyor 10 where damaged or rotten potatoes as well as large stones and other debris 12 which has been collected along with the potatoes 4 may be manually removed. The potatoes 4 then pass onto the grader of the invention, indicated generally by reference number 20, where the potatoes 4 are agitated and small seed potatoes 4*a* fall through an endless screen grid conveyor 21 of the grader 20 for removal on a transversely mounted cross conveyor 22 which fills a box 24 via a fall breaker 26 at the distal end 28 of the cross conveyor 22. Larger ware potatoes 4*b* do not fall through the grader 20 and are carried thereon into a padded collection hopper 30 for separate collection. As will be seen from FIG. 1 the potato grader and separator 1 is provided with wheels 32 so that it may be moved from field to field or farm as required.

Figure 2:
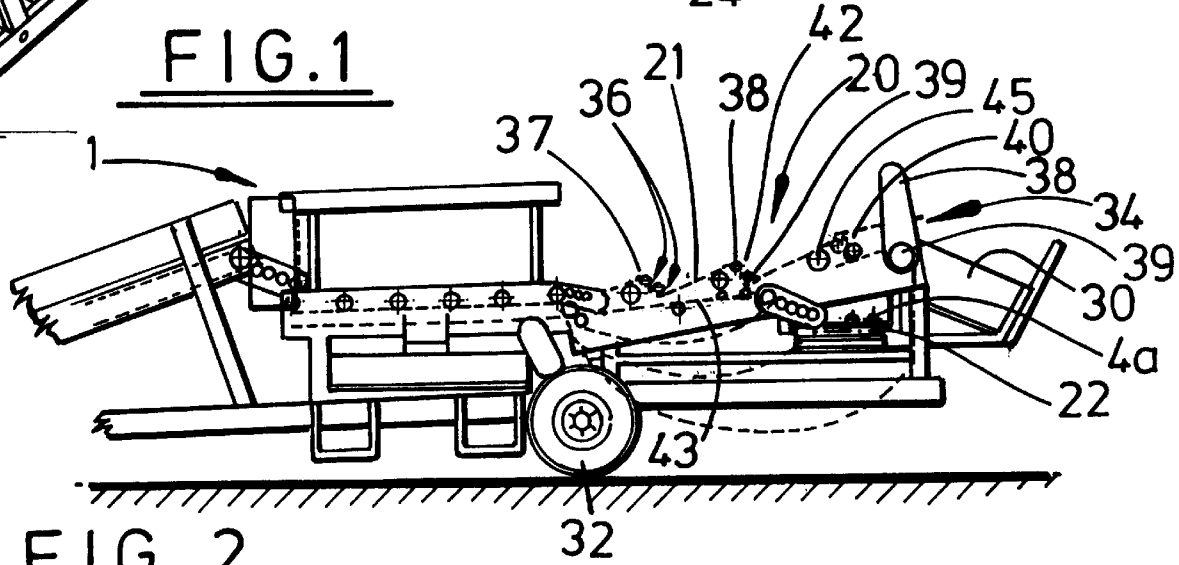
FIG. 2 is a cutaway side elevation of the potato grader and separator in FIG. 1.

In more detail and with reference to FIG. 2 the grader 20 comprises an inclined framework 34 having a series of guide rollers 36 on which is supported the endless screen grid conveyor 21 which is supported at either side by resiliently deformable endless drive transmission belts 37. The belts 37 are driven by an electric motor 38 powered drive roller 39.

To enable the screen to move easily and evenly round the drive roller and especially the guide rollers 36, 39 with reverse flexing of the traction or transmission belts 37 as they are bent first in one direction and then in the opposite direction, it is an advantage to fix the rods 47 (see also FIG. 6) of the screen grid conveyor 21 to the traction belts 37 in the centre of the belt as opposed to riveted to the top in conventional manner. This is done by moulding the traction belt around the rod at the time of construction of the screem as shown in FIG. 7 and further described in our co-pending application No. PCT/GB94/00520.

The guide rollers 36 are arranged in pairs at opposite sides 23, 25 of the screen grid conveyor 21 for guiding engagement with the respective belt 37 at each side, with one roller 38 in each pair 36 at each side above, and one 39 below the belt 37 so as to define a generally 'S' or 'Z'-shaped path (depending on which side it is viewed from) for the belt 37 and the screen grid conveyor 21. In this way a plurality of cascades or steps 40 is formed in the screen grid conveyor 21 so that tubers passing over the lip 42 of each cascade 40 tumble over onto the section of the screen grid conveyor 21 thereby being more or less gently tumbled to improve passage of smaller seed potatoes through the screen grid conveyor 21 directly onto the cross conveyor 22 or onto a secondary conveyor 43 which carries them along onto the cross conveyor 22.

In order to prevent damage to any tubers which become jammed or trapped in the openings 44 in the screen grid conveyor 21, a large diameter polished steel ejector roller 45 is mounted at the underside of the endless screen grid conveyor 21 immediately upstream of each cascade 40 and extending across the full width of the screen grid conveyor 21—in contrast to the guide rollers 38, 39 which are disposed below and above the drive belts 37, only. The ejector rollers 45 are conveniently driven by chain so that the outer cylindrical surface thereof travels at a slightly faster speed, ca. 5% faster, than the screen grid conveyor 21 thereby to assist in the ejection of tubers projecting through the screen grid openings 44 below the underside of the screen grid conveyor 21.

Figure 3:
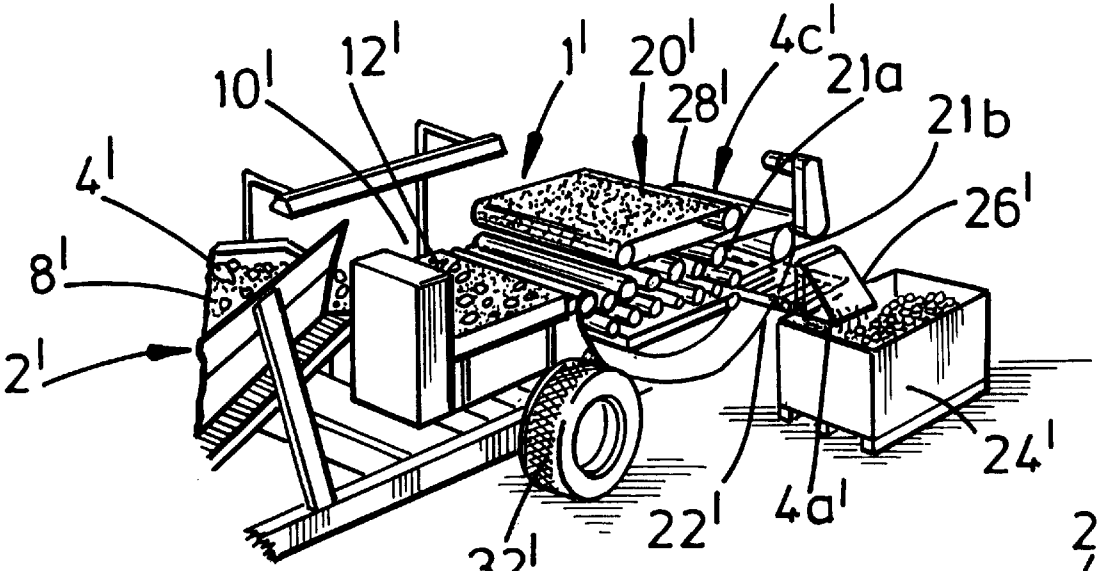
FIG. 3 shows a perspective partial view of a second embodiment of potato grader and separator, generally similar to that in FIG. 1.
Figure 4:
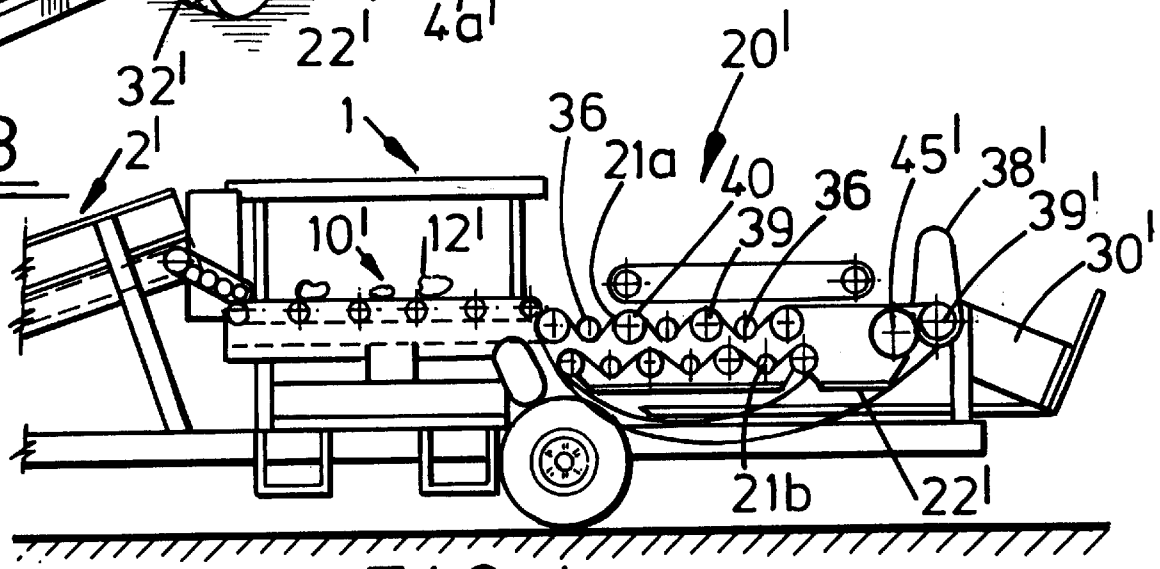
FIG. 4 is a side view similar to that of FIG. 2 of the embodiment shown in FIG. 3.
Figures 5, 6, 7:
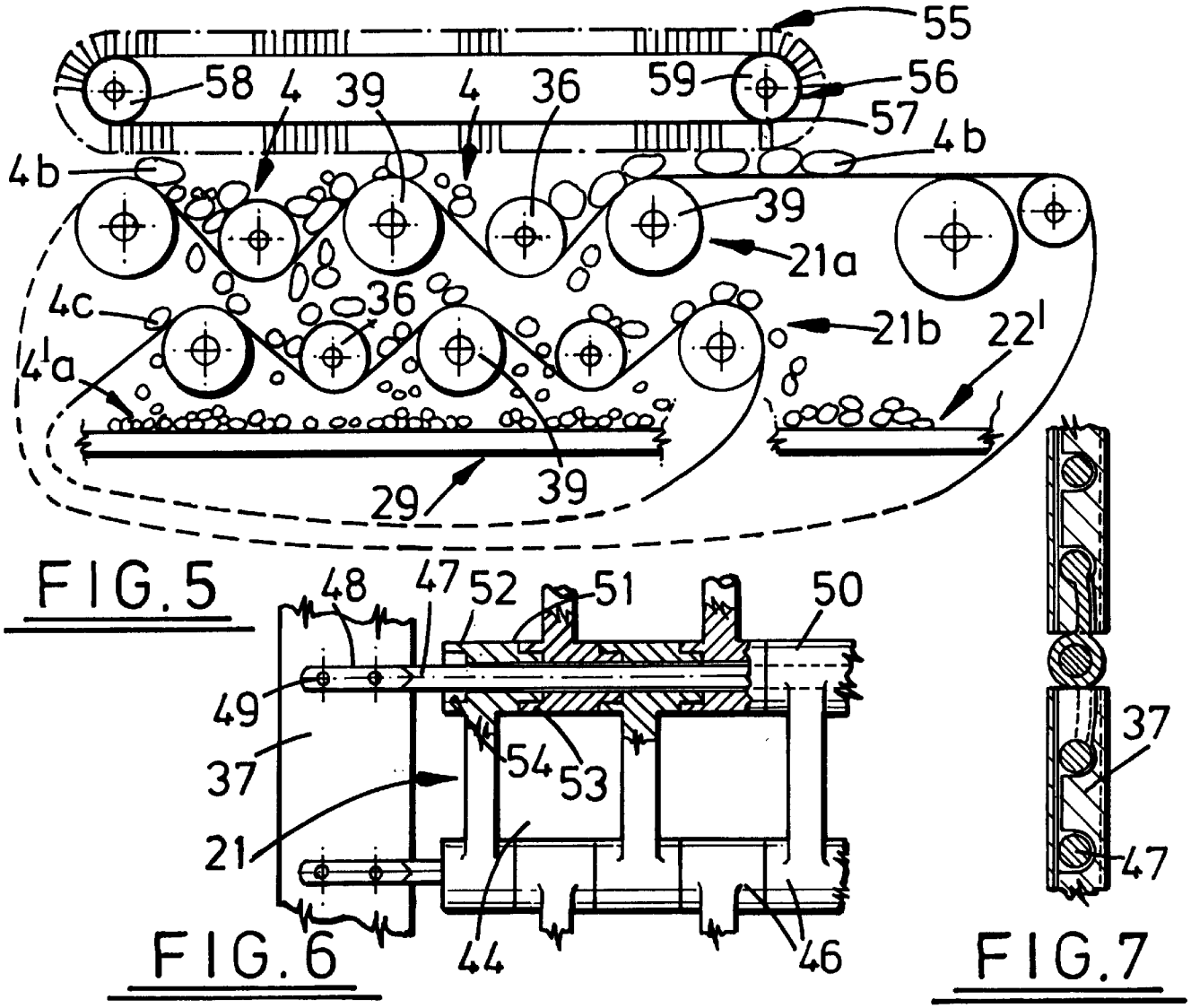
FIG. 5 is a detailed side view of the potato grader in FIG. 3.
FIG. 6 is a partial detail plan view of the grid screen of the grader of FIG. 1 on an enlarged scale.
FIG. 7 is a detail transverse sectional view along a drive belt of a grid screen with a modified cross-bar mounting.

FIGS. 3 to 5 show a second embodiment of potato grader generally indicated by like reference numbers to those in FIGS. 1 and 2 with a prime added, for separating seed and ware potatoes $\mathbf{4}^1$. The grader and separator $\mathbf{1}^1$ comprises a bulk hopper $\mathbf{2}^1$ (only partially shown) into which are loaded harvested potatoes $\mathbf{4}^1$. The hopper $\mathbf{2}^1$ is provided with soil extraction rollers which remove excess soil $\mathbf{8}^1$ collected with the potatoes $\mathbf{4}^1$ and conveys the potatoes $\mathbf{4}^1$ to a manual precleaning conveyor $\mathbf{10}^1$ where damaged or rotten potatoes as well as large stones and other debris $\mathbf{12}^1$ which has been collected along with the potatoes $\mathbf{4}^1$ may be manually removed. The potatoes $\mathbf{4}^1$ then pass onto the grader of the invention, indicated generally by reference number $\mathbf{20}^1$ where the potatoes $\mathbf{4}^1$ are agitated and small 4*a* and medium 4*c* sized potatoes $\mathbf{4}^1$ fall through a first upper endless screen grid conveyor 21*d* of the grader $\mathbf{20}^1$ onto second lower endless screen grid conveyor 21*b* of the grader $\mathbf{20}^1$. The second lower screen 21*b* allows the smallest potatoes $\mathbf{4}a^1$ to pass through for collection on a lower collection plate 29. Medium sized potatoes 4*c* do not pass through the second lower screen 21*b* and are collected for removal on a transversely mounted cross conveyor $\mathbf{22}^1$ which fills a box $\mathbf{24}^1$ via a fall breaker $\mathbf{26}^1$ at the distal end $\mathbf{28}^1$ of the cross conveyor $\mathbf{22}^1$. The largest 4*b* of the potatoes do not fall through either of first or second grid conveyors 21*a, b* of the grader $\mathbf{20}^1$ and are carried thereon into a padded collection hopper (not shown) for separate, collection. As with the embodiment in FIG. 1 the potato grader and separator is provided with wheels $\mathbf{32}^1$ so that it may be moved around as required.

The embodiment of potato grader shown in FIGS. 3 and 4 and as further described with reference to FIG. 5 also has an overhead conveyor 55 comprising an endless pintle 56 belt 57 mounted on two return rollers 58, 59 one of which is driven by a motor (not shown). The overhead conveyor pintle belt 56 positively engages potatoes 4 on the upper grid conveyor 21*a* so as to turn and spread them on the screen grid thereby assisting passage of them through the upper screen grid 21*a*.

As shown in FIG. 6, the screen grid conveyor 21 comprises a large number of generally "I"-shaped link members 46 mounted on cross-bars 47 whose ends 48 are secured by rivets 49 to drive belts 37 or inside the traction belt to enable the rod to travel on a centre line of the belt FIG. 7. In more detail each link member has hollow tubular cross-pieces 50 which are a loose clearance fit around the respective cross-bars 47. Each cross piece 50 has moreover at opposite ends 51, 52 male and female portions 53, 54 which are a close fit with opposite gender portions of adjacent link members 46 so as to permit relative pivoting of coupled cross-pieces 50 substantially only about a common central longitudinal axis of said cross-pieces 50 thereby to maintain dimensional stability of the openings 44 defined by the link members 46. (It will of course be appreciated that instead of cross pieces with opposite gender end portions there could instead be used alternating cross-pieces each with one or other gender i.e. male-male, female-female etc.)

As noted above, the tubular cross-pieces 50 are a loose clearance fit around the cross-bars 47 i.e. have a minimum internal diameter 1 or 2 mm larger than the external diameter of the latter. This allows the recti-linear link members 46 to be offset slightly as the belts 37 and cross-bars 47 secured thereto negotiate the arcuate path portions defined by the guide and return rollers.

FIG. 7 shows a detail transverse sectional view along a drive belt 37 of a grid screen with a modified cross-bar 47 mounting.

For the avoidance of doubt it should be understood that the "grader" of the present invention may be used in all types of grading and separating including field grading, pre-grading, seed and/or ware size grading, supermarket and other commercial distribution grading, in dedicated grading machinery, in separators and in potato harvesters, static or mobile, whether for potatoes or other like goods or produce.

I claim:

1. An endless conveyor grader (1) suitable for use in grading and/or separating tubers (4) or the like wherein the endless conveyor (21) comprises an endless grid screen (21) supported on endless drive transmission means (37) at opposite sides (23, 25) of said endless grid screen (21) for transmitting drive to said endless grid screen (21), and there are provided, at opposite sides (23, 25) of a pathway followed by the endless grid screen (21), endless drive transmission guide means (36, 39) for guiding said endless drive transmission means (37) in such a way as to define at least one step (40) in the endless grid screen pathway, characterized in that the downstream side of the or each step is inclined forwardly in the direction of travel of the endless grid screen, with the base of the or each said step being spaced sufficiently forward from the lip of the or each said step in order, during use of the grader (1), to cause tubers (4) passing over said lip of the or each step (40) to tumble over the grid screen (21) without falling or dropping generally vertically onto the screen, thereby providing the required movement of tubers (4) on said grid screen (21) for facilitating the grading and/or separating process.

2. An endless conveyor grader (1) as claimed in claim 1 wherein said endless drive transmission guide means are in the form of pairs of more or less closely spaced guide rollers (36, 39) or sprockets defining a generally 'S'-shaped pathway for said endless drive transmission means (37).

3. An endless conveyor grader (1) as claimed in claim 2 wherein said endless drive transmission means (37) is selected from a belt, a chain and a cable.

4. A endless conveyor grader (1) as claimed in claim 1 where said endless grid screen (21) comprises a multiplicity of substantially parallel support bars bridging across said endless drive transmission means (37) with a multiplicity of generally 'I'-shaped link members (46) with hollow cross-members (50) bridging across pairs of successive support bars (47) so as to define an endless grid sreen (21) with said bars (47) extending through said hollow cross members (50), said hollow cross members having closely fitting male (53) and female (54) end portions for positive coupling of adjacent link members so as to allow relative rotation at the coupling whilst substantially maintaining dimensional stability of openings (44) provided in said grid screen (21) in use of the endless grid screen (21), said hollow coupled cross-members (50) having a minimum internal diameter slightly larger than the external diameter of said bars so as to allow relative movement between the grid screen link members (46) and said support bars (47) transversely of the support bars at non-rectilinear portions of the grid screen (21) pathway, thereby facilitating traversal of changes of direction on the endless grid screen (21) pathway whilst maintaining dimensional stability of the grid screen openings (44).

5. An endless conveyor grader (1) as claimed in claim 4 wherein said link members (46) of said endless grid screen have a principal dimensional tolerance of 0.1 mm or less.

6. An endless conveyor grader (1) as claimed in claim 5 wherein said lint members (46) of said endless grid screen are made from a plastics material selected from polypropylene, polyamide or polyvinylchloride.

7. An endless conveyor grader as claimed in claim 6 wherein said link members (46) of said endless grid screen define openings (44) having rectangular, oval, round or polygonal configuration.

8. An endless conveyor grader as claimed in claim 7 wherein said link members (46) of said endless grid screen are precision cast or injection moulded.

9. An endless conveyor grader (1) according to claim 4 wherein at least a portion of said endless grid screen pathway has a generally saw-toothed profile.

10. An endless conveyor grader (1) according to claim 9 wherein said generally saw-toothed profile extends substantially horizontally.

11. An endless conveyor grader (1) according to claim 10, wherein the teeth of said saw-toothed profile include obtuse angles.

12. An endless conveyor grader (1) according to claim 9 wherein said openings (44) in said grid screen have a common predetermined opening diameter and the pitch of said saw-toothed profile is substantially greater than the predetermined opening diameter of said grid screen openings.

13. An endless conveyor grader (1) according to claim 4, wherein the or each step comprises an upward slope at an effective tuber elevating angle and a downward slope at an effective downward tuber conveying angle.

14. An endless conveyor grader (1) as claimed in claim 1 wherein said endless grid screen (21) is provided with a plurality of openings (44) having a common predetermined opening diameter and there is provided at a said step (40) an ejector roller (45) extending substantially across the width of the endless grid screen at or in close proximity to the underside of the endless grid screen, said ejector roller having a large diameter of at least two times said predetermined opening diameter, for ejecting, in use of the separator, tubers or the like which may become jammed in the grid screen openings.

15. An endless conveyor grader (1) as claimed in claim 14 having from three to six said steps (40) defined in said endless grid screen pathway.

16. An endless conveyor grader (1) as claimed in claim 15 provided with an overhead conveyor (55) having a surface configured so as to positively engage tubers (4) or the like on said endless grid screen (21) so as to turn and spread them on the endless grid screen thereby assisting tubers (4) or the like downwardly through said endless grid screen (21).

17. An endless conveyor grader (1) as claimed in claim 16 wherein said overhead conveyor (55) is in the form of an endless belt (57) having a surface of resiliently deformable material.

18. An endless conveyor grader (1) as claimed in claim 16 wherein said overhead conveyor (55) is in the form of an endless belt (57) or chain having mounted thereon a plurality of spaced apart flights projecting downwardly into close proximity with said grid screen (21).

19. An endless conveyor grader (1) as claimed in claim 16 wherein said overhead conveyor (55) is in the form of an endless belt (57) or chain having a multiplicity of finger (56) or bristle elements projecting downwardly into close proximity with said grid screen (21).

20. An endless conveyor grader (1) as claimed in claim 16 wherein said overhead conveyor (55) comprises a plurality of generally cylindrical brushes for rotating in the same direction for guiding and driving tubers (4) or the like along said grid screen (21).

21. An endless conveyor grader (1) as claimed in claim 20 provided with at least two nested endless conveyor graders (21) according to claim 1 mounted with their grading reaches one above the other, the uppermost grader (21*a*) having a larger grid screen (21) opening (44) than the grader (21*b*) therebelow whereby a plurality of differently sized tubers (4*a, b, c*) or the like may be separated and graded in a single grader/harvester/separator.

22. A harvester incorporating an endless conveyor grader according to claim 1.

23. An endless conveyor grader (1) suitable for use in grading and separating tubers (4) or the like and having an endless grid screen (21) which is provided with a plurality of openings having a common predetermined opening diameter, characterised in that there is provided, substantially directly upstream of a change of direction in a pathway followed by the endless grid screen (21), extending substantially across the width of the endless grid screen at or in close proximity to the underside of endless grid screen, an ejector roller (45) having a large diameter of at least two times said predetermined opening diameter, for ejecting, in use of the separator, tubers (4) or the like which may become jammed in the grid screen (21) openings (44).

24. An endless conveyor grader (1) as claimed in claim 23 wherein said ejector roller (45) has a large diameter three times said predetermined opening diameter.

25. An endless conveyor grader (1) as claimed in claim 23 wherein said ejector roller (45) has a smooth substantially cylindrical surface.

26. An endless conveyor grader (1) as claimed in claim 23, wherein said ejector roller (45) is driven at a speed of from three to seven per cent faster than that of said grid screen (21).

27. A method of grading and/or separating tubers or the like, characterized in that said method comprises the steps of: providing an endless conveyor grader (1) according to claim 1, and conveying said tuners (4) or the like on said endless conveyor over the or each said step (40) thereby tumbling the tubers (4) over on the grid screen (21), without falling or dropping generally vertically onto the grid screen (21) to provide the required movement of the tubers on said grid screen (21) for facilitating the grading and/or separating process.

* * * * *